United States Patent [19]

Towns et al.

[11] Patent Number: 4,673,096

[45] Date of Patent: Jun. 16, 1987

[54] CLOSURE AND ROTATABLE LINER

[75] Inventors: Edward J. Towns, Morristown; Edward M. Brown, Livingston, both of N.J.; William M. Lester, DelRay Beach, Fla.

[73] Assignee: TBL Development Corporation, Livingston, N.J.

[21] Appl. No.: 812,777

[22] Filed: Dec. 23, 1985

[51] Int. Cl.[4] ..... B65D 41/04

[52] U.S. Cl. ..... 215/230; 215/270; 215/271; 215/344

[58] Field of Search ..... 215/341, 343, 345, 349, 215/350, 230, 260, 270, 271, DIG. 1

[56] References Cited

U.S. PATENT DOCUMENTS 2,681,742 6/1954 Miller ..... 215/350
2,746,632 5/1956 Bramming ..... 215/270
4,360,114 11/1982 Owens ..... 215/DIG. 1

FOREIGN PATENT DOCUMENTS 610464 10/1960 Italy ..... 215/270
1255739 12/1971 United Kingdom ..... 215/350

*Primary Examiner*—Donald F. Norton
*Attorney, Agent, or Firm*—Robin, Blecker & Daley

[57] ABSTRACT

A container closure includes a closure member having a top panel and a liner retained rotatively in the closure member, the liner having an upper surface in facing relation to the top panel and a lower surface opposite such first liner surface. The liner has configuration in its upper surface for limiting engagement between same and the top panel to a fraction of interfacing surfaces thereof. The liner has a member depending from its lower surface for sealing engagement with a container.

12 Claims, 11 Drawing Figures

CLOSURE AND ROTATABLE LINER

FIELD OF THE INVENTION

This invention relates generally to containers and closures therefor and pertains more particularly to improved liners for sealing containers and closure members cooperative therewith.

BACKGROUND OF THE INVENTION

In various instances the container industry looks to closures for containment of substances under pressure in containers. Typically, this objective is attained by the use of closures of type including a closure member, having a top panel and a threaded skirt dependent therefrom, and a sealing member or liner within the closure member and adapted to perform the actual sealing function as the closure is applied to the container.

A common problem in the container industry is that the force necessary to open pressurized containers is excessive, particularly for aged persons or people otherwise having limitations in respect of unthreading closures applied to such containers. Thus, while it is necessary that the torque applied to closures for adequate substance containment pressurization be be quite high, the industry has not heretofore sufficiently relieved the torque required to be applied to such closures for removal thereof, such removal or opening torque generally being equal to or greater than the closing torque.

Clearly, an unsatisfied need of the container industry is to realize a diminution of the ratio of opening closure torque to closing closure torque, from that presently obtaining.

In other aspect, applicants herein note the shortcomings of the art in addressing the matter of providing assurance to interested parties, i.e., container manufacturers, distributors and consumers, of continuance of initial pressurization of containers.

SUMMARY OF THE INVENTION

A primary object of the invention is the provision of improved container closures.

A particular object of this invention is the provision of container closures having diminished ratios of opening torque to closing torque.

A more specific object of the invention is the provision of improved liners for container closures and improved closure member structure for use with the same.

A further object of the invention is to provide improved containers for containment of pressurized substances.

Still another object of the invention is the provision of improved liners and container closures for providing indication of continuance of initial pressurization of containers.

In the efficient attainment of the foregoing and other objects, the invention provides a container closure having a closure member with a top panel and a liner retained rotatively in the closure member. The liner has a first surface in facing relation to the top panel and of configuration adapted to limit engagement between the liner and the top panel to a fraction of the interfacing surfaces thereof. The liner has a second surface opposite its first surface and a sealing member (or members) depends from the liner second surface for sealing engagement with a container.

In a preferred embodiment, such liner first surface configuration includes a circular projection having a depression at its apex, thus providing first and second radially spaced uppermost projection surfaces which constitute plural such limited engagement locations for the top panel and liner. In such embodiment, the sealing member may comprise a cone located in registry with the liner first surface depression, for purpose and function discussed hereinafter.

In vacuum container application, as a closure of the invention is applied to a container, the vacuum enhances the action of the sealing cone, which is flared radially outwardly. A consequence of such sealing enhancement, in the absence of further structure of the invention or its equivalent, is an increase in the magnitude of required closure opening or removal torque.

A benefit flowing from the limitation of engagement, per the invention, as between the closure member top panel and the liner, is that closure opening torque is lessened. Thus, the closure member rides rotatively upon the projection surfaces and lifts the liner periphery in the course of rotation and attendant axial upward displacement, relieving the vacuum force on the liner.

The liner may further be equipped with a central projection on its first (upper) surface which seats in a central passage extending through the top panel of the closure member, as set forth in commonly-assigned patent application, Ser. No. 766,381, filed on Aug. 18, 1985 and entitled "Pressure-Indicative Container Closure and Method of Making Same". Here, the liner is drawn centrally away from the closure member top panel by the vacuum and the projection is displaced to nest in the top panel passage. Upon loss of vacuum, the liner returns to disposition adjacent the top panel and the liner projection becomes viewable above the top panel.

In positive container pressurization aspect, applicants form the container liner with such first surface projection in axially recessed registry with such central passage extending through the top panel of the closure member. Here, the liner is formed with a cone flexibly dependent from the liner surface engaging the top panel, such cone being urged toward the top panel by the container positive pressurization, whereby the projection is viewable above the top panel on assembly. Upon loss of positive pressurization of the container, the liner returns to disposition remote from the top panel, the projection thereupon nesting in the top panel passage, beneath or even with the upper surface thereof.

The invention will be further understood from the following detailed description of preferred embodiments and practices thereof and from the drawings wherein like reference numerals identify like parts and components throughout.

DESCRIPTION OF PREFERRED EMBODIMENTS AND PRACTICES

Figure 1:
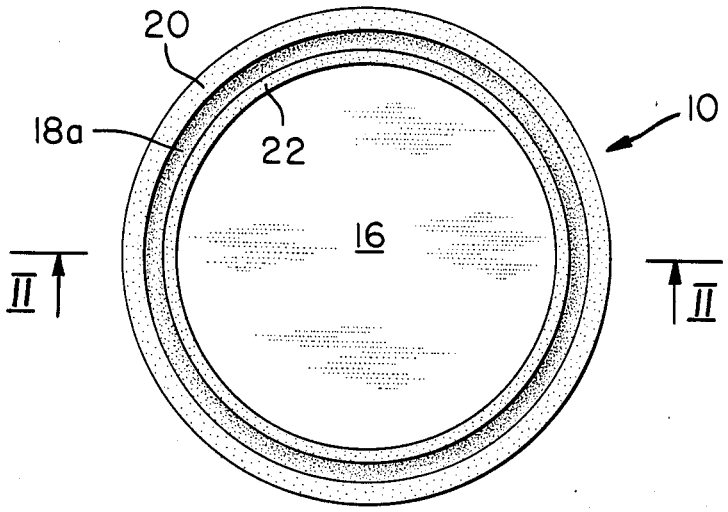
FIG. 1 is a top plan view of a preferred embodiment of a liner constructed in accordance with the invention.
Figure 2:
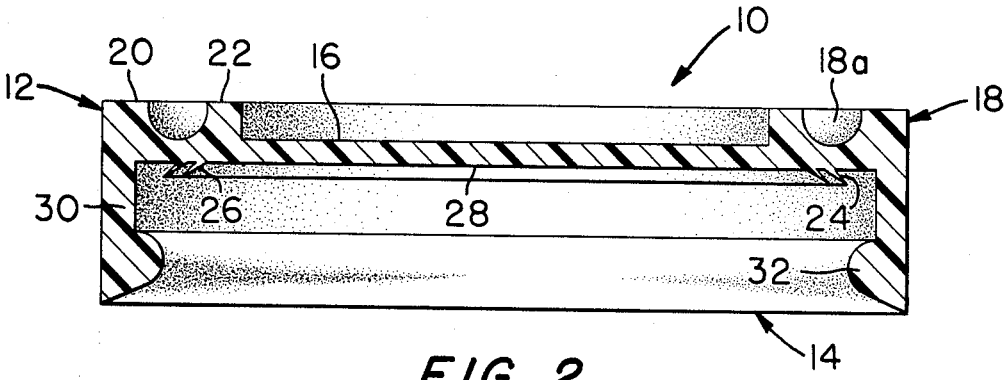
FIG. 2 is an enlarged sectional view of the FIG. 1 liner, as would be seen from plane II—II of FIG. 1.

Referring to FIGS. 1 and 2, liner 10 is a cylindrical body 12 of resilient plastic material having lower open end 14. Upper surface 16 of liner 10 has a projection 18 extending upwardly peripherally thereof. An indentation or depression 18*a* is formed in projection 18, such that it defines two uppermost projection surfaces 20 and 22, which are mutually radially spaced endless courses.

Sealing members 24 and 26 depend downwardly from lower surface 28 of liner 10, each such member being in the form of a cone flaring radially outwardly to sealing apices. Sidewall 30 of liner 10 is enlarged at bead 32.

Figure 3:
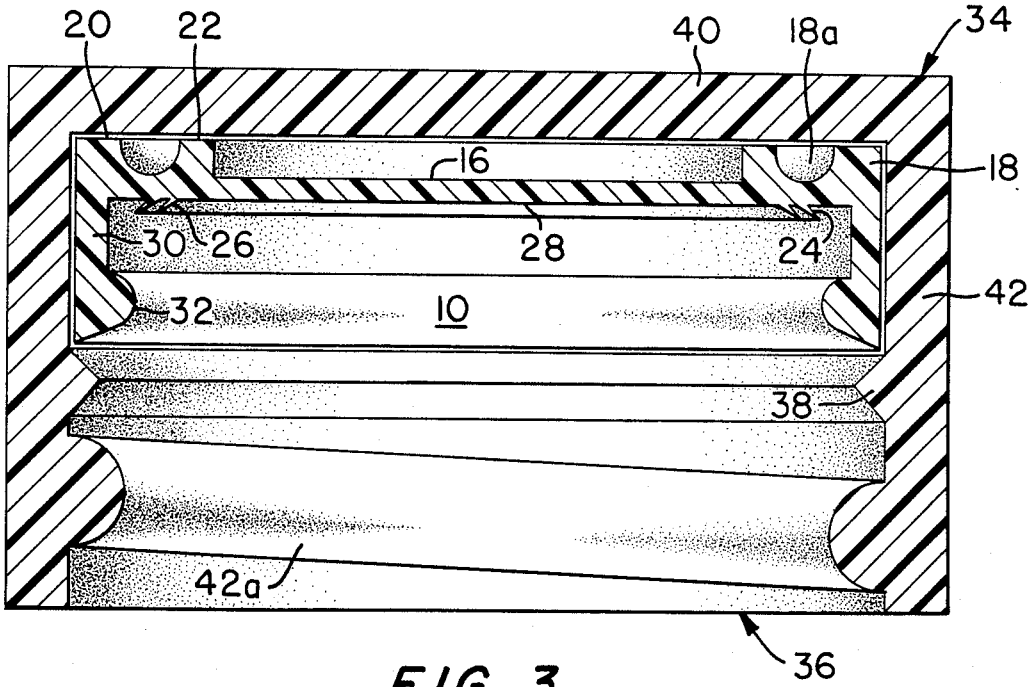
FIG. 3 is a repeat showing of the FIG. 2 sectional view, further including a preferred embodiment of a closure member in association therewith.

Turning to FIG. 3, liner 10 is shown assembled with closure member 34, the liner having been inserted through opening 36, beyond retention lip 38 and into the upper portion of the hollow closure member interior. Liner 10 is thus retained rotatively in closure member 34, i.e., they are rotatable relative to one another, since the retention is mechanical, such parts having been separately formed.

Closure member 34 is shown as being of synthetic material, but may be of metal, as desired. It includes top panel 40 and depending skirt 42, which defines retention lip 38 and interior threading 42.

The undersurface of closure member top panel 40 and liner upper surface 16 are in interfacing relation in the FIG. 3 assembly. However, engagement between such interfacing surfaces is limited by projection 18 to a fraction thereof. Thus, engagement is limited to liner uppermost projection surfaces 20 and 22 and facing top panel undersurface. While shown as flat surfaces, surfaces 20 and 22 may be essentially point surfaces by increasing the width of indentation 18*a*, again as may be desired.

Figure 4:
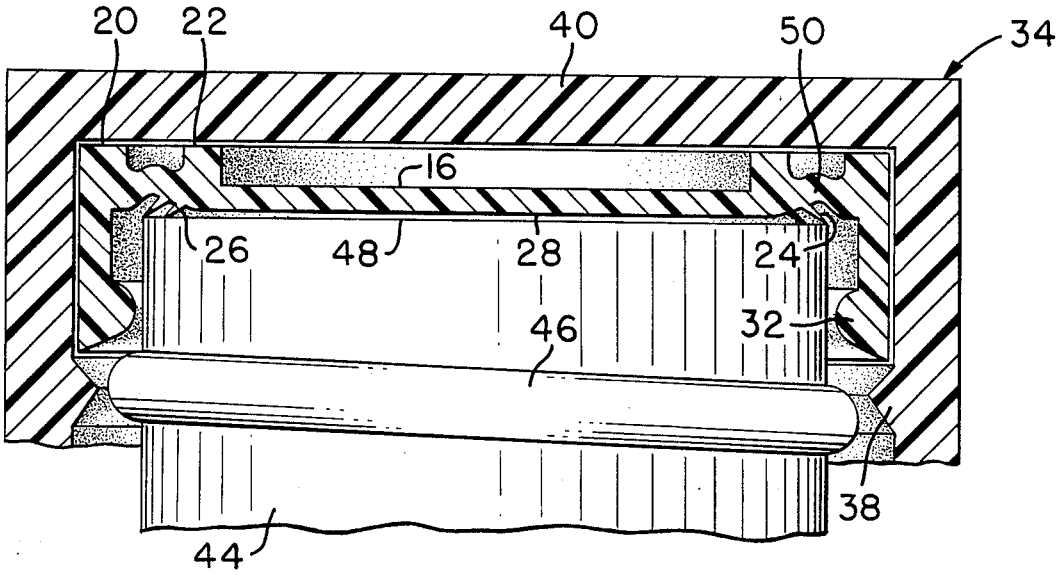
FIG. 4 is a repeat showing of the FIG. 3 closure in association with a container, wherein the closure is applied securely to the container.

In FIG. 4, the closure of FIG. 3 is shown applied to container 44, having threading 46 and being shown without sectioning. Container 44 has flat sealing surface 48. In the course of applying the FIG. 3 closure to container 44, the apices of sealing members 24 and 26 engage container surface 48 and, as threading continues, increased sealing occurs through both the resiliency of liner 10 and the vacuum in container 44.

In the preferred illustrated embodiment, indentation 18*a* and the apices of sealing members 24 and 26 are in mutual registry axially of the closure. Accordingly, a thinned-out section 50 of projection 18 exists at the bottom of indentation 18*a*. It is found that such section 50 deforms upwardly in the course of assembly (as shown in FIG. 4), further enhancing the sealing activity since section 50 biases the sealing members 24 and 26 downwardly onto container surface 48.

In the course of closure opening and removal activity, closurc member 34 is rotated in counterclockwise sense, giving rise to upward vertical movement of closure member 34 relative to container 44. Irrespective of the sealing force which may exist, initial rotation of closure member 34 is without great resistance, due to the fractional surface engagement of liner 10 and top panel 40. On continued rotation, retention lip 38 forcibly engages liner bead 32, applying lifting force thereto. This elevates the liner, particularly permitting section 50 to return to the original shape of indentation 18*a* and relieving forces on sealing members 24 and 26, thereby releasing the vacuum and its force thereon.

Figure 5:
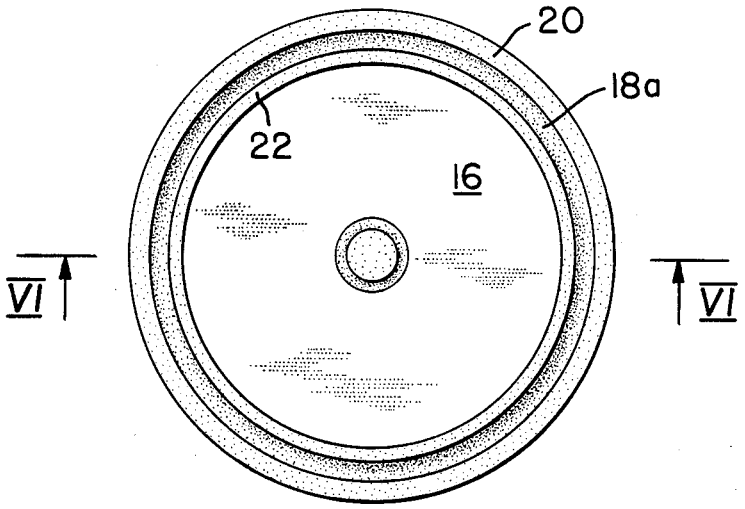
FIG. 5 is a top plan view of another preferred embodiment of a liner constructed in accordance with the invention.
Figure 6:
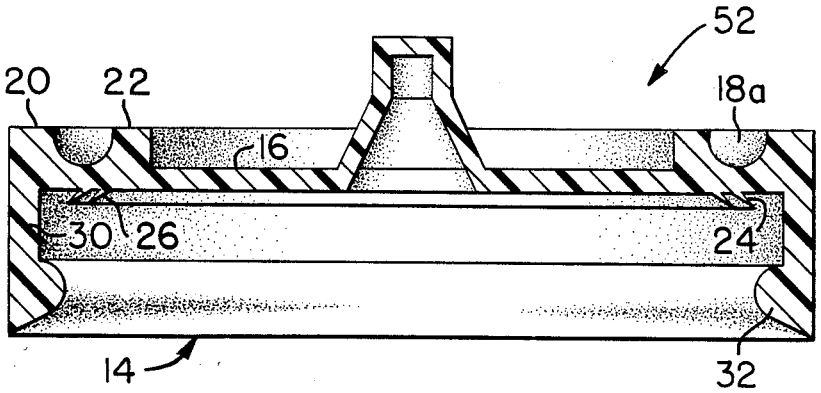
FIG. 6 is an enlarged sectional view of the FIG. 5 liner, as would be seen from plane VI—VI of FIG. 5.

A second embodiment of liner in accordance with the invention is seen at 52 in FIGS. 5 and 6. This liner configuration includes that of FIGS. 1 and 2, which is commonly identified by the previously used reference numerals, but departs in its central region to that of the Ser. No. 766,381 pending application referred to above.

Figure 7:
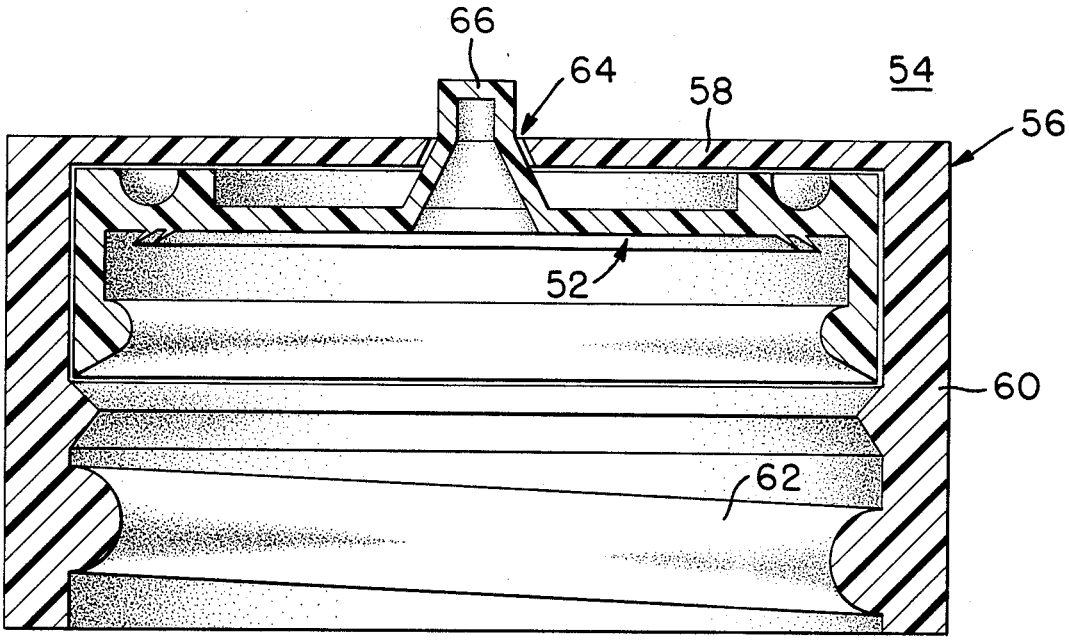
FIG. 7 is a repeat showing of the FIG. 6 sectional view, further including a preferred embodiment of a closure member in association therewith.

Referring to FIGS. 5–7, closure 54 includes cap or closure member 56 having a top panel 58 and a skirt 60, interiorly threaded at 62, an opening or passage 64 being formed through top panel 58. Liner 52 of closure 54 has a central projection 66 resident in top panel opening 64 and extending substantially above the upper surface thereof. Liner 52 self-biases to such normal disposition upon manufacture and prior to application to a container, as is shown in FIG. 7.

As in the case of liner 10 and the FIG. 3 closure, closure member 56 and liner 52 are selected to be of mutually non-adhering plastics and, accordingly, the upper surface 16 of liner 52 and undersurface of top panel 58 are not adheringly engaged, i.e., are not bonded to one another, and the interior extent of liner 52 is thus free to move from its illustrated FIG. 7 disposition and deform under the influence of negative pressure thereon in the course of securement of closure 54 to a vacuum container.

Such vacuum pressurization attending the application of closure 54 to a container occasions withdrawal of the interior extent of liner 52 from its normal disposition relative to closure member 56 and entry thereof into the neck of the container. In the course of this action, projection 66 recedes from its prior disposition exteriorly of closure member 56, i.e., well above top panel 58 thereof, to be essentially flush with or below the top panel upper surface. Upon loss of vacuum in such container, the closure will assume the normal configuration thereof in FIG. 7, with projection 66 clearly above the top panel of the closure member, providing visible indication to a manufacturer, retailer or consumer of vacuum loss. With the liner material and the closure member materials of respective different contrasting colors, the indication is heightened in visibility.

Figure 8:
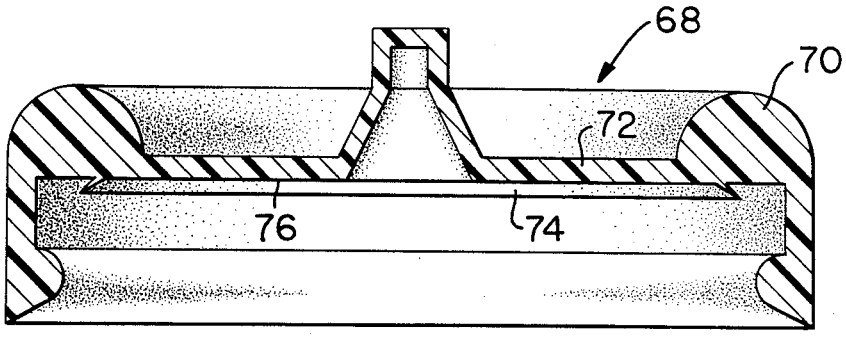
FIG. 8 is a third liner embodiment in central section.

FIG. 8 shows a third embodiment of liner in accordance with the invention at 68. Here, the central liner structure of FIGS. 5–7 is carried over with a liner-top panel engagement limiting dome 70 extending outwardly of liner upper surface 72 and a single sealing cone 74 depending from liner undersurface 76.

Figure 9:
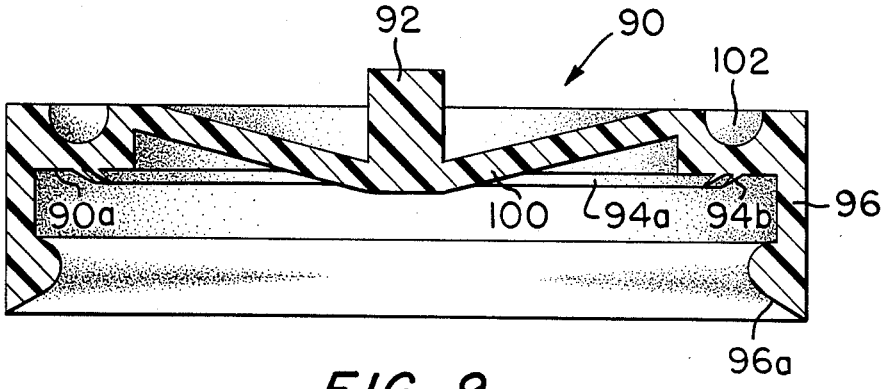
FIG. 9 is a fourth liner embodiment in central section.
Figure 10:
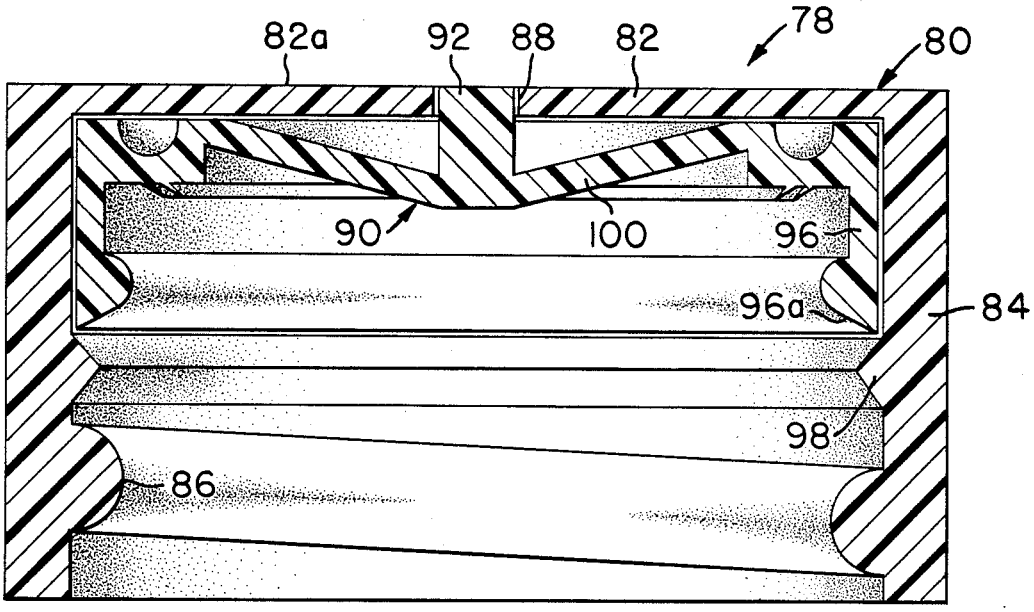
FIG. 10 is a repeat showing of the FIG. 9 sectional view, further including a preferred embodiment of a closure member in association therewith.

Referring to FIGS. 9 and 10, closure 78 includes cap or closure member 80 having a top panel 82 and a skirt 84, interiorly threaded at 86, an opening or passage 88 being formed through top panel 82. Liner 90 of closure 78 has a central projection 92 resident in top panel opening 88 and disposed below or even with the upper surface 82*a* thereof.

Liner 90 further includes, dependent from its lower surface 90*a*, sealing members 94*a*, 94*b* adapted to engage the upper neck surface of a container to seal same. Liner 90 self-biases to its normal disposition (FIG. 9) upon manufacture and prior to application to a container. Liner 90 defines an annular depending skirt 96 extending downwardly to an end surface 96*a*, which nests within an annular detent rib or lip 98 formed interiorly of closure member 80 on skirt 84. The interior conical extent 100 of liner 90 is free to move from its illustrated disposition and deform.

The positive pressurization attending the application of the closure to the container occasions such deformation of the interior conical extent 100 of liner 90 from such normal disposition relative to closure member (FIGS. 9 and 10). In the course of this action, projection 92 advances from its prior disposition remote from closure member 80, i.e., well below top panel 82 thereof, to be substantially above the top panel upper surface 82*a*. Radially inwardly directed sealing surfaces 94*a*, 94*b* are then in sealing engagement with the top surface of the container neck and the threading of the closure is in meshed engagement with counterpart container threading to maintain the assembly. Upon loss of positive pressure in the container, the closure will assume the normal configuration thereof in FIG. 10, with projection 92 below or even with the top panel of the closure member, thus providing visible indication to a manufacturer, retailer or consumer of loss of positive pressurization.

Figure 11:
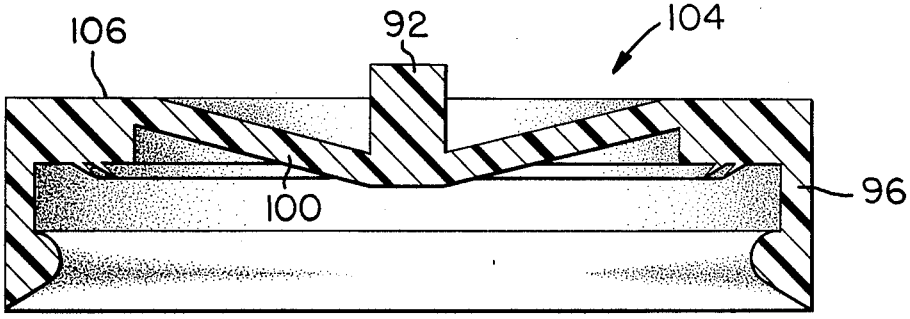
FIG. 11 is a fifth liner embodiment in central section.

While liner 90 of FIG. 9 includes an annular indentation 102, as in the previous liner embodiments, which serves likewise to limit liner-closure member engagement, liner 104 of FIG. 11 omits such indentation and has continuous surface 106.

It is found that closures constructed in accordance with the invention may be removed from container with about one-half the opening torque required for the removal of conventional closures.

Various changes to the foregoing liners, closure members and closures and modifications to the indicated practices may be introduced without departing from the invention. By way of example, the liner uppermost projection surfaces, while shown as endless may be circularly discontinuous. The preferred embodiments and practices are thus intended in an illustrative and not in a limiting sense. The true spirit and scope of the invention is set forth in the following claims.

We claim:

1. A container closure comprising a liner and a closure member, said closure member having a top panel, a skirt depending from said top panel and skirt interior threading, said skirt defining an interior cylindrical recess, said skirt having interior projection means located axially between said recess and said threading for axial retention of said liner, said liner having a cylindrical sidewall nested in said recess for rotation in said closure member, said liner having a first surface in facing relation to said top panel and a second surface opposite such first liner surface, said liner having first means projecting outwardly of said first liner surface for limiting engagement between said first liner surface and said top panel, said liner having second means depending from said second surface for sealing engagement with such container.

2. The invention claimed in claim 1 wherein said liner first and second means are in mutual registry axially of said closure.

3. The invention claimed in claim 2 wherein said liner is selectively deformable in the portion thereof having said liner first and second means.

4. The invention claimed in claim 3 wherein said liner is cylindrical and wherein said first means comprises a circular projection extending outwardly of said first liner surface.

5. The invention claimed in claim 4 wherein said second means comprises a least one cone extending from said liner second surface radially outwardly toward the liner perimeter.

6. The invention claimed in claim 4 wherein said projection includes an indentation therein forming respective first and second radially spaced uppermost projection surfaces constituting plural locations for engagement of said top panel and said liner.

7. The invention claimed in claim 6 wherein said liner has thickness and resilience selected such that the portions of said liner in registry with said indentation are elastically deformable upon such application of said closure to said container.

8. The invention claimed in claim 7 wherein said top panel has an opening extending therethrough, and wherein said liner includes a further projection resident in such top panel opening and extending outwardly of said top panel.

9. The invention claimed in claim 1 wherein said top panel has an opening extending therethrough, and wherein said liner includes a projection resident in such top panel opening and extending outwardly of said top panel.

10. The invention claimed in claim 1 wherein said liner includes extent interiorly adjacent said liner first means normally disposed adjacent said closure member but movable away from said closure member under the influence of vacuum pressure in said closure, said liner including a projection thereon, said closure member defining a passage therethrough for residence of said projection, said projection being configured to project outwardly of said passage in such normal disposition of said liner and to nest inwardly of said passage upon such movement of said liner interior extent away from said closure member.

11. The invention claimed in claim 1 wherein said liner includes extent interiorly adjacent said liner first means normally disposed remotely from said closure member but movable toward from said closure member under the influence of positive pressure in said closure, said liner including a projection thereon, said closure member defining a passage therethrough for residence of said projection, said projection being configured to nest inwardly of said passage in such normal disposition of said liner and to project outwardly of said passage upon such movement of said liner interior extent toward said closure member.

12. A container closure comprising a closure member and a liner rotatively supported at its periphery by said closure member and including extent interiorly of said liner periphery and normally disposed adjacent said closure member but movable away from said closure member under the influence of vaccum pressure in said closure, said liner including a projection thereon, said closure member defining a passage therethrough for residence of said projection, said projection being configured to project outwardly of said passage in such normal disposition of said liner and to nest inwardly of said passage upon such movement of said liner interior extent away from said closure member.

* * * * *